US006598391B2

(12) United States Patent
Lunzman et al.

(10) Patent No.: US 6,598,391 B2
(45) Date of Patent: Jul. 29, 2003

(54) CONTROL FOR ELECTRO-HYDRAULIC VALVE ARRANGEMENT

(75) Inventors: Stephen Victor Lunzman, Chillicothe, IL (US); Xiaodong Huang, Peoria, IL (US); Kirk Stephen Shively, Dunlap, IL (US); Bradford Jay Holt, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 128 days.

(21) Appl. No.: 09/939,809

(22) Filed: Aug. 28, 2001

(65) Prior Publication Data

US 2003/0041728 A1 Mar. 6, 2003

(51) Int. Cl.[7] ..... F15B 13/044
(52) U.S. Cl. ..... 60/327; 91/454
(58) Field of Search ..... 91/433, 454; 60/327

(56) References Cited

U.S. PATENT DOCUMENTS

| | | | |
|---|---|---|---|
| 4,220,004 A | 9/1980 | Abeille et al. | |
| 4,587,883 A | 5/1986 | Ehrentraut et al. | |
| 4,741,247 A | 5/1988 | Glomeau et al. | |
| 4,790,233 A | 12/1988 | Backe et al. | |
| 4,811,561 A | 3/1989 | Edwards et al. | |
| 4,951,549 A | 8/1990 | Olsen et al. | |
| 5,012,415 A | 4/1991 | Boe et al. | |
| 5,135,031 A | 8/1992 | Burgess et al. | |
| 5,218,820 A | 6/1993 | Sepehri et al. | |
| 5,469,646 A | 11/1995 | Takamura | |
| 5,469,694 A | 11/1995 | Panousheck et al. | |
| 5,474,147 A | 12/1995 | Yesel et al. | |
| 5,553,683 A | 9/1996 | Wenzel et al. | |
| 5,701,691 A | 12/1997 | Watanabe et al. | |
| 5,784,945 A | 7/1998 | Krone et al. | |
| 5,897,287 A | 4/1999 | Berger et al. | |
| 5,921,165 A | 7/1999 | Takahashi et al. | |
| 5,953,977 A | 9/1999 | Krishna et al. | |
| 5,960,695 A | 10/1999 | Aardema et al. | |
| 6,098,322 A | 8/2000 | Tozawa et al. | |
| 6,467,264 B1 * | 10/2002 | Stephenson et al. | 91/454 |

* cited by examiner

*Primary Examiner*—Edward K. Look
*Assistant Examiner*—Michael S Leslie
(74) *Attorney, Agent, or Firm*—Finnegan & Henderson

(57) ABSTRACT

A system and method for controlling an electro-hydraulic valve arrangement to provide make-up fluid to a hydraulic actuator are disclosed. The system includes an electro-hydraulic valve arrangement actuated by a control lever and disposed between a pump having a stand-by pressure and a hydraulic actuator. A pressure, representative of the fluid in the hydraulic actuator, is sensed and compared to the stand-by pressure of the pump. The control of the control lever over the electro-hydraulic valve arrangement is overridden when the difference between the pump stand-by pressure and the pressure of the fluid in the hydraulic actuator is greater than a predetermined pressure limit.

17 Claims, 3 Drawing Sheets

CONTROL FOR ELECTRO-HYDRAULIC VALVE ARRANGEMENT

TECHNICAL FIELD

The present invention is directed to a system and method for controlling an electro-hydraulic valve arrangement. In particular the present invention is directed to a system and method for controlling an electro-hydraulic valve arrangement to provide make-up fluid to a hydraulic actuator.

BACKGROUND

Hydraulic actuators, such as piston/cylinder arrangements or fluid motors, are commonly used to move work implements, such as, for example, buckets or shovels. Each hydraulic actuator typically includes at least two fluid chambers that are disposed on opposite sides of a moveable element. The moveable element is, in turn, connected to the work implement that is to be moved. A pump is typically connected to the hydraulic actuator to selectively provide pressurized fluid to one or the other of the fluid chambers of the hydraulic actuator. These systems typically include an electro-hydraulic valve arrangement that selectively connects the pump with one of the fluid chambers.

When it is desirable to move the work implement in a certain direction, the electro-hydraulic valve arrangement is moved so that pressurized fluid is provided to one chamber of the hydraulic actuator at the same time that fluid is allowed to flow out of the other chamber. This creates a pressure differential over the moveable element of the hydraulic actuator. Provided that the force exerted on the moveable element by the pressurized fluid is great enough to overcome the resistant force of the work implement, the moveable element will move towards the area of lower fluid pressure existing in the opposite chamber of the hydraulic actuator, thereby moving the work implement.

An operator is typically provided with a control lever that governs the motion of the work implement. When the operator moves the control lever towards a first operative position, the electro-hydraulic valve arrangement is moved to allow pressurized fluid to flow into the first chamber of the hydraulic actuator and out of the second chamber, which results in the work implement moving in the first direction. Similarly, when the operator moves the control lever to a second operative, the electro-hydraulic valve arrangement is moved to allow pressurized fluid to flow into the second chamber of the hydraulic actuator and out of the first chamber, which results in the work implement moving in the second direction.

When the operator moves the lever to a neutral position, the electro-hydraulic valve arrangement closes so that fluid stops flowing to either side of the hydraulic actuator. If the operator abruptly moves the control lever to the neutral position, the momentum of the work implement will continue to act on the hydraulic actuator. If the work implement is carrying a heavy load, this momentum may increase the pressure in the hydraulic actuator, or a connecting fluid line, to a high level. A relief valve, disposed in the fluid line, may open to release fluid and reduce the pressure in the system.

The release of fluid from one chamber allows the moveable element to continue moving, thereby increasing the volume of the opposite chamber. If no additional fluid enters the opposite chamber, the pressure within the opposite chamber will drop. If the pressure drops enough, the hydraulic actuator may experience cavitation, which can be damaging to the equipment within the system. To prevent cavitation, additional fluid, or make-up fluid, must be added to the opposite chamber to compensate for the expulsion of fluid through the relief valve.

Typically, as shown in U.S. Pat. No. 5,921,165, additional valves are included in the hydraulic actuator control system to provide make-up fluid to the hydraulic actuator. These valves will open to provide the additional fluid to the hydraulic actuator when one of the chambers is susceptible to cavitation, i.e., experiencing a low or negative pressure. However, these types of arrangements are also costly in that additional valves and control devices are required. In addition, these types of arrangements provide very little control over when additional fluid is added to the system. For example, these types of arrangements do not provide appropriate make-up flow when all levers are in their neutral positions and a cylinder is still in motion.

The present invention provides a system and method for providing make-up fluid to a hydraulic actuator that solves all or some of the problems set forth above.

SUMMARY OF THE INVENTION

Accordingly, the present invention is directed to a method and system for controlling an electro-hydraulic valve arrangement. This method and system controls the electro-hydraulic valve arrangement, based on sensed parameters, to provide make-up fluid to a hydraulic actuator. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a method of controlling an electro-hydraulic valve arrangement that is actuated by a control lever having a neutral position and is disposed between a pump having a stand-by pressure and an actuator. According to the method, an actuator pressure that is representative of the fluid pressure in the actuator is sensed. The actuator pressure is compared to the pump stand-by pressure. The control of the control lever is overridden to allow fluid to flow from the pump through the electro-hydraulic valve arrangement to the actuator when the difference between the pump stand-by pressure and the actuator pressure is greater than a predetermined limit.

In another aspect, the invention is directed to a system for controlling a flow of fluid to a hydraulic actuator. The system includes a pump that has a stand-by pressure. An electro-hydraulic valve arrangement is in fluid connection with the pump and the hydraulic actuator. The electro-hydraulic valve controls the amount of fluid flowing from the pump to the hydraulic actuator. A control lever having a neutral position is provided. Movement of the control lever to the neutral position acts to close the electro-hydraulic valve arrangement and prevent the flow of fluid to the hydraulic actuator. A pressure sensor senses a first pressure representative of the pressure of the fluid within the hydraulic actuator. A control device is provided to override the closing of the electro-hydraulic valve arrangement when the difference between the pump stand-by pressure and the first pressure is greater than a predetermined limit.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Figure 1:
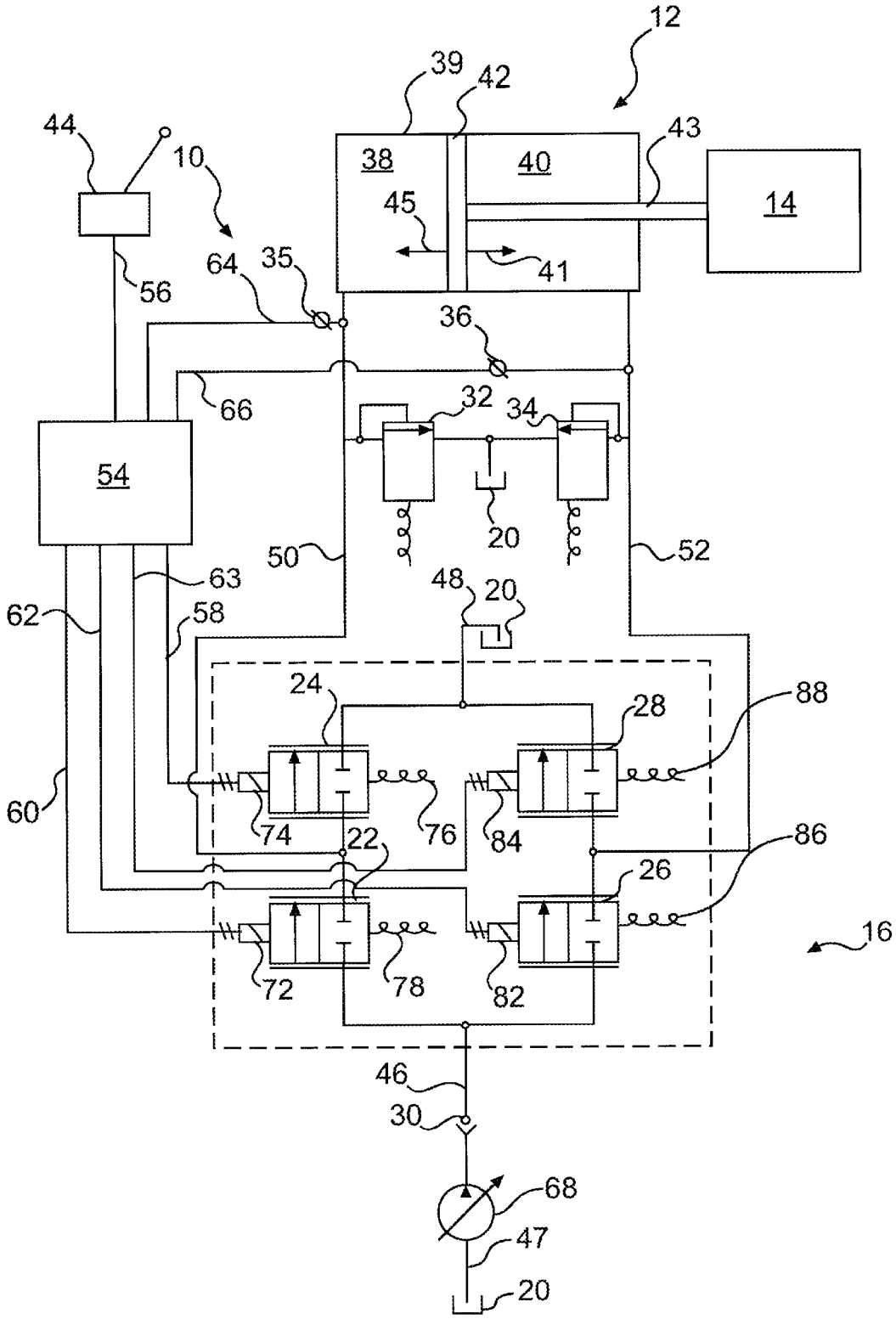
FIG. 1 is a schematic diagram of a system for controlling an electro-hydraulic valve arrangement in accordance with the present invention.

Reference will now be made in detail to embodiments of the invention, examples of which are illustrated in the accompanying drawings. Wherever possible, the same reference numbers will be used throughout the drawings to refer to the same or like parts.

In accordance with the present invention, a system and method for controlling an electro-hydraulic valve arrangement is provided. The electro-hydraulic valve arrangement is used to provide a flow of pressurized fluid to a hydraulic actuator. The hydraulic actuator may be a piston and cylinder combination, as illustrated in the drawings, or another type of actuator, such as a fluid motor. An exemplary embodiment of a system for controlling an electro-hydraulic valve arrangement is illustrated in FIG. 1 and is generally designated by the reference number 10.

As shown in FIG. 1, system 10 is connected to a hydraulic actuator 12. In the illustrated embodiment, hydraulic actuator 12 includes a piston 42 having a piston rod 43. Piston rod 43 is connected to a load 14. It is contemplated that load 14 may be an implement of a work machine, such as, for example, a bucket, fork, or other earth or material moving implement. These types of work machines include, for example, wheel loaders, track type loaders, or hydraulic excavators.

As also shown in FIG. 1, piston 42 is disposed in a housing 39 to form a first chamber 38 and a second chamber 40 that are disposed on opposite sides of piston 42. Each of the first and second chambers 38 and 40, respectively, are configured to receive and hold a pressurized fluid. Piston rod 43 extends from and is slidably disposed in one end of housing 39.

In accordance with the present invention, a pump having a stand-by pressure is provided to supply pressurized fluid to the hydraulic actuator. It is contemplated that the pump may be of any variety readily apparent to one skilled in the art, such as, for example, a piston pump, gear pump, vane pump, or gerotor pump. In the currently contemplated embodiment, the pump is a variable capacity pump, although it is contemplated that the pump may be a fixed capacity pump with a bypass valve to control standby pressure.

As schematically illustrated in FIG. 1, a pump 68 is placed in fluid connection with a tank 20 that contains a reservoir of fluid at an ambient pressure through a fluid line 47. Pump 68 is also connected to fluid line 46, which ultimately leads to hydraulic actuator 12.

When actuator 12 is in operation, pump 68 draws fluid from tank 20 and works the fluid to a particular pressure. Pump 68 then transfers the pressurized fluid to fluid line 46. In the illustrated embodiment, a check valve 30 is placed in fluid line 46. Check valve 30 allows fluid to flow through fluid line 46 when the pressure of the fluid on the pump side of check valve 30 is greater than the pressure of the fluid on the actuator side of check valve 30. In this manner, check valve 30 prevents fluid from returning from the hydraulic actuator 12 to pump 68.

Pump 68 is designed to have a stand-by pressure. In a variable displacement pump, the stand-by pressure is the fluid pressure produced by the pump when the pump is operating at its minimum displacement and a no load situation. It is expected that the stand-by pressure of the pump will be within the range of about 2000–3000 kPa (290–430 psi), although the exact stand-by pressure will depend upon the system requirements. In a fixed displacement pump, the stand-by pressure of the pump is the fluid pressure produced by the pump during its standard operation. However, a predetermined stand-by pressure can be obtained for a fixed displacement pump through the use of a bypass valve.

Figure 2:
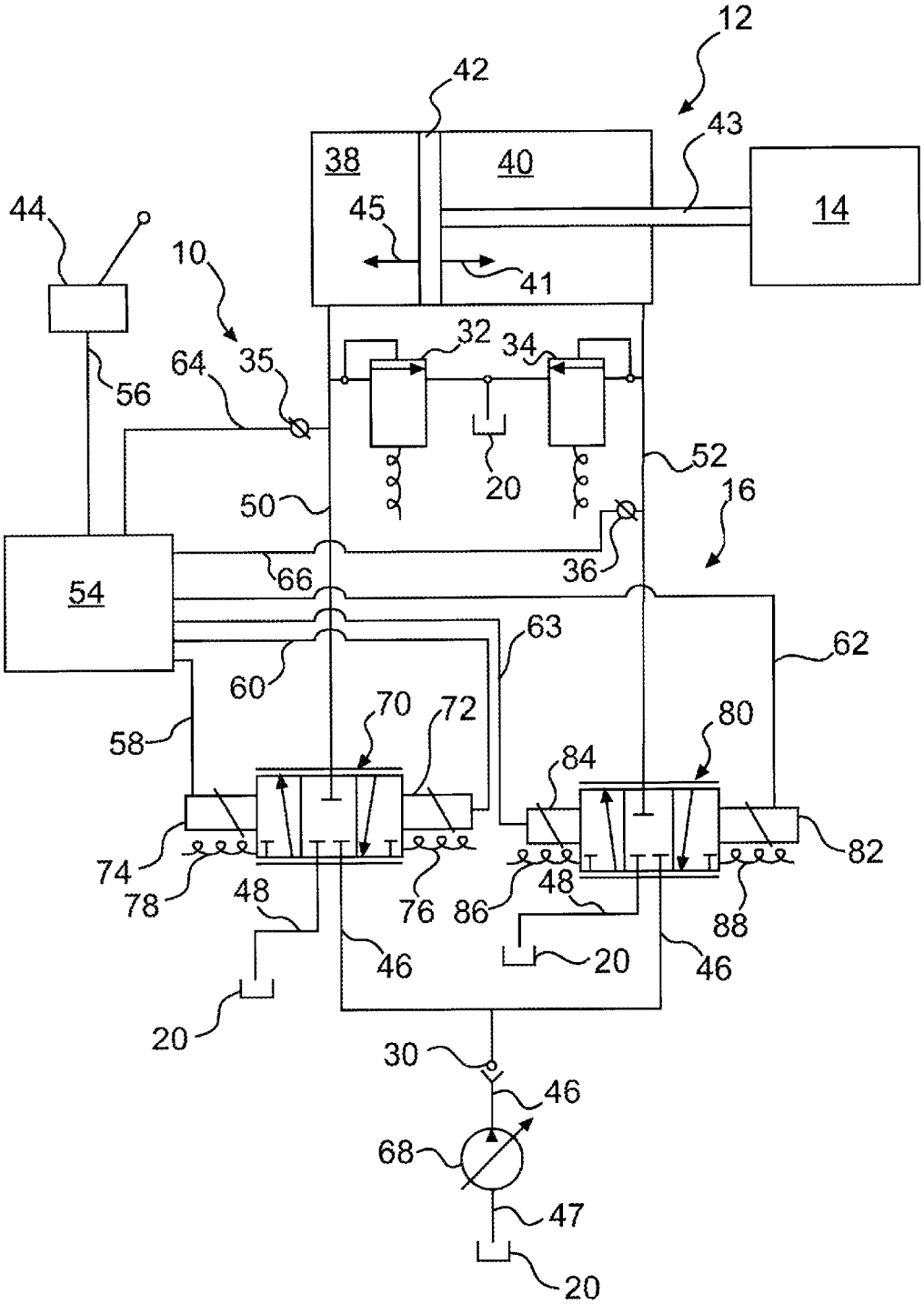
FIG. 2 is a schematic diagram of another embodiment of a system for controlling an electro-hydraulic valve arrangement in accordance with the present invention.

In accordance with the present invention, an electro-hydraulic valve arrangement is placed in fluid connection between the pump and the hydraulic actuator. The electro-hydraulic valve arrangement is selectively operable to connect one of the first and second chambers of the hydraulic actuator with the pump while connecting the other of the first and second chambers with the tank. The electro-hydraulic valve arrangement may also be closed to prevent fluid from flowing from the pump to the hydraulic actuator. As illustrated in FIG. 1, the electro-hydraulic valve arrangement may include a series of independent metering valves that individually control fluid flow into and out of the first and second chambers of the hydraulic actuator. Alternatively, as illustrated in FIG. 2, the electro-hydraulic valve arrangement may include a split spool valve arrangement.

As shown in FIG. 1, an electro-hydraulic valve arrangement 16 is placed in fluid connection with pump 68 and hydraulic actuator 12. In the embodiment illustrated in FIG. 1, electro-hydraulic valve arrangement 16 include four independent metering valves 22, 24, 26, and 28. In the currently contemplated embodiment, each independent metering valve is a proportional valve so that the flow of fluid through each valve may be varied depending upon load/system requirements.

As illustrated, first metering valve 22 and third metering valve 26 are connected to pump 68 through a fluid line 46. Second metering valve 24 and fourth metering valve 28 are connected to tank 20 through a fluid line 48. First and second metering valves 22 and 24 are connected to first chamber 38 through a fluid line 50. Third and fourth metering valves 26 and 28 are connected to second chamber 40 through a fluid line 52.

First metering valve 22 includes a first solenoid 72. Energizing first solenoid 72 acts on first metering valve 22 to move the valve towards an open position to place first chamber 38 in controlled fluid connection with pump 68. A first spring 78 also acts on first metering valve 22 to return first metering valve 22 to a closed position when first solenoid 72 is de-energized.

Second metering valve 24 includes a second solenoid 74. Energizing second solenoid 74 acts on second metering valve 24 to move the valve towards an open position to place first chamber 38 in controlled fluid connection with tank 20. A second spring 76 also acts on second metering valve 24 to return the valve to a closed position when second solenoid 74 is de-energized.

Third metering valve 26 includes a third solenoid 82. Energizing third solenoid 82 acts on third metering valve 26 to move the valve towards an open position to place second chamber 40 in controlled fluid connection with pump 68. A third spring 86 also acts on third metering valve 26 to return the valve to a closed position when third solenoid 82 is de-energized.

Fourth metering valve 28 includes a fourth solenoid 84. Energizing fourth solenoid 84 acts on fourth metering valve 28 to move the valve towards an open position to place second chamber 40 in controlled fluid connection with tank 20. A fourth spring 88 also acts on fourth metering valve 28 to return the valve to a closed position when fourth solenoid 84 is de-energized.

In this embodiment, the motion of hydraulic actuator 12 is controlled by selectively and controllably opening and closing independent metering valves 22, 24, 26, and 28. In standard operation, to move hydraulic actuator 12 in a first direction (as illustrated by arrow 41), first metering valve 22 and fourth metering valve 28 are controllably opened at the same time. This places first chamber 38 in connection with pump 68 and second chamber 40 in connection with tank 20, which allows pressurized fluid to flow to first chamber 38 and fluid to flow from second chamber 40. The pressurized fluid entering first chamber 38 exerts a force on piston 42 to move load 14 in the first direction. When the operation is complete, first solenoid 72 and fourth solenoid 84 are de-energized, thereby returning first metering valve 22 and fourth metering valve 28 to their closed positions.

Similarly, to move hydraulic actuator 12 in a second direction (as illustrated by arrow 45) second metering valve 24 and third metering valve 26 are controllably opened at the same time. This places second chamber 40 in connection with pump 68 and first chamber 38 in connection with tank 20, which allows pressurized fluid to flow to second chamber 40 and fluid to flow from first chamber 38. The pressurized fluid entering second chamber 40 exerts a force on piston 42 to move load 14 in the second direction. When the operation is complete, second solenoid 74 and third solenoid 82 are de-energized, thereby returning second metering valve 24 and third metering valve 26 to their closed positions.

Alternatively, as illustrated in FIG. 2, electro-hydraulic valve arrangement 16 may include a split spool valve arrangement, shown as a first metering valve 70 and a second metering valve 80. In the illustrated embodiment, first metering valve 70 is disposed between pump 68, first chamber 38 of hydraulic actuator 12, and tank 20. Second metering valve 80 is disposed between pump 68, second chamber 40 of hydraulic actuator 12, and tank 20.

As shown, first metering valve 70 is a three-position electro-hydraulic valve that controls the rate and direction of fluid flow into and out of first chamber 38. In the illustrated closed position, first metering valve 70 prevents fluid from flowing to or from first chamber 38 of hydraulic actuator 12. A first solenoid 72, when energized, moves first metering valve 70 towards a first open position, where pump 68 is controllably connected to first chamber 38 to allow fluid to flow from the pump 68 to first chamber 38. When first solenoid 72 is de-energized, a first spring 78 returns first metering valve 70 to the closed position. A second solenoid 74, when energized, moves first metering valve 70 towards a second open position where first chamber 38 is controllably connected to tank 20 to allow fluid to flow from first chamber 38 to tank 20. When second solenoid is de-energized, a second spring 76 returns first metering valve 70 to the closed position.

As also shown in FIG. 2, second metering valve 80 is a three-position electro-hydraulic valve that controls the rate and direction of fluid flow into and out of second chamber 40. In the illustrated closed position, second metering valve 80 prevents fluid from flowing to or from second chamber 40 of hydraulic actuator 12. A third solenoid 82, when energized, moves second metering valve 80 towards a first open position, where pump 68 is controllably connected to second chamber 40 to allow fluid to flow from pump 68 to second chamber 40. When third solenoid 82 is de-energized, a third spring 86 returns second metering valve 80 to the closed position. A fourth solenoid 84, when energized, moves second metering valve 80 towards a second open position where second chamber 40 is controllably connected to tank 20 to allow fluid to from second chamber 40 to the tank 20. When fourth solenoid is de-energized, a fourth spring 88 returns second metering valve 80 to the closed position.

In the embodiment of FIG. 2, the motion of hydraulic actuator 12 is controlled by coordinated opening and closing of first and second metering valves 70 and 80. When first metering valve 70 is moved to the first open position so that pressurized fluid flows from pump 68 to first chamber 38, second metering valve must be moved to the second open position to allow fluid to flow from second chamber 40 to tank 20. Similarly, when second metering valve 80 is moved to the first open position so that pressurized fluid flows from pump 68 to second chamber 40, first metering valve 70 must be moved to the second open position to allow fluid to flow from first chamber 38 to tank 20.

As illustrated in FIGS. 1 and 2, a first pressure relief valve 32 is attached to fluid line 50 between electro-hydraulic valve arrangement 16 and first chamber 38 and a second pressure relief valve 34 is attached to fluid line 52 between electro-hydraulic valve arrangement 16 and second chamber 38. First and second pressure relief valves 32 and 34 are set to open at a predetermined pressure. If the fluid pressure in either fluid line 50 or fluid line 52 exceeds the predetermined pressure, which would indicate an overpressure situation, one of first and second pressure relief valves 32 and 34 would open to allow fluid to flow from the fluid line to tank 20. The escape of fluid to tank 20 would prevent the pressure in the respective fluid line from exceeding the predetermined pressure.

In accordance with the present invention, a pressure sensor is provided to sense a pressure representative of the pressure of the fluid within the hydraulic actuator. The pressure sensor may include one or more pressure gauges disposed in the system to sense the pressure of fluid within at least one of the first and second chambers of the hydraulic actuator. The pressure sensor may be disposed at any point within the system that will allow the pressure sensor to sense a pressure representative of the fluid pressure within at least one fluid chamber of the hydraulic actuator.

As illustrated in FIGS. 1 and 2, a first pressure gauge 35 is connected to fluid line 50 and a second pressure gauge 36 is connected to fluid line 52. First pressure gauge 35 reads the pressure of the fluid in fluid line 50, which is representative of the fluid pressure within first chamber 38 of hydraulic actuator 12. Second pressure gauge 36 reads the pressure of the fluid in fluid line 52, which is representative of the fluid pressure in second chamber 40 of hydraulic actuator 12. The present invention contemplates that first and second pressure gauges 35 and 36 may be disposed at any point along fluid lines 50 and 52 or may be connected to first or second chambers 38 and 40, provided that first and second pressure gauges 35 and 36 sense pressures that are representative of the fluid pressure within the respective chamber of the hydraulic actuator. First and second pressure gauges 35 and 36 may also be disposed at the outlet of the electro-hydraulic valve arrangement 16, such as at the outlets of first metering valve 22 and third metering valve 26 in the embodiment of FIG. 1 or at the outlets of first and second metering valves 70 and 80 in the embodiment of FIG. 2.

In accordance with the present invention, a control lever is provided. The control lever may be a joystick or other operative control accessible to an operator. The operator may manipulate the control lever to govern the motion of the hydraulic actuator and, thus, the corresponding work implement. The present invention contemplates that the control lever has at least three positions, a neutral position, a first operative position, and a second operative position.

As illustrated in FIGS. 1 and 2, a control lever 44 is connected to system 20. When control lever 44 is in the neutral position, each solenoid within electro-hydraulic valve arrangement 16 is de-energized so that all valves are moved to the closed position to prevent fluid from flowing to or from hydraulic actuator 12. Accordingly, hydraulic actuator 12 remains motionless.

When control lever 44 moves towards the first operative position, the appropriate solenoids within electro-hydraulic valve arrangement 16 are energized to allow pressurized fluid to flow from pump 68 into first chamber 38 and to allow fluid to flow out of second chamber 40 to tank 20. In response, piston 42 and load 14 will move in the first direction (as indicated by arrow 41).

When control lever 44 moves to the second operative position, the appropriate solenoids within electro-hydraulic valve arrangement 16 are energized to allow pressurized fluid to flow from pump 68 into second chamber 40 and to allow fluid to flow out of first chamber 38 to tank 20. In response, piston 42 and load 14 will move in the second direction (as indicated by arrow 45).

Figure 3:
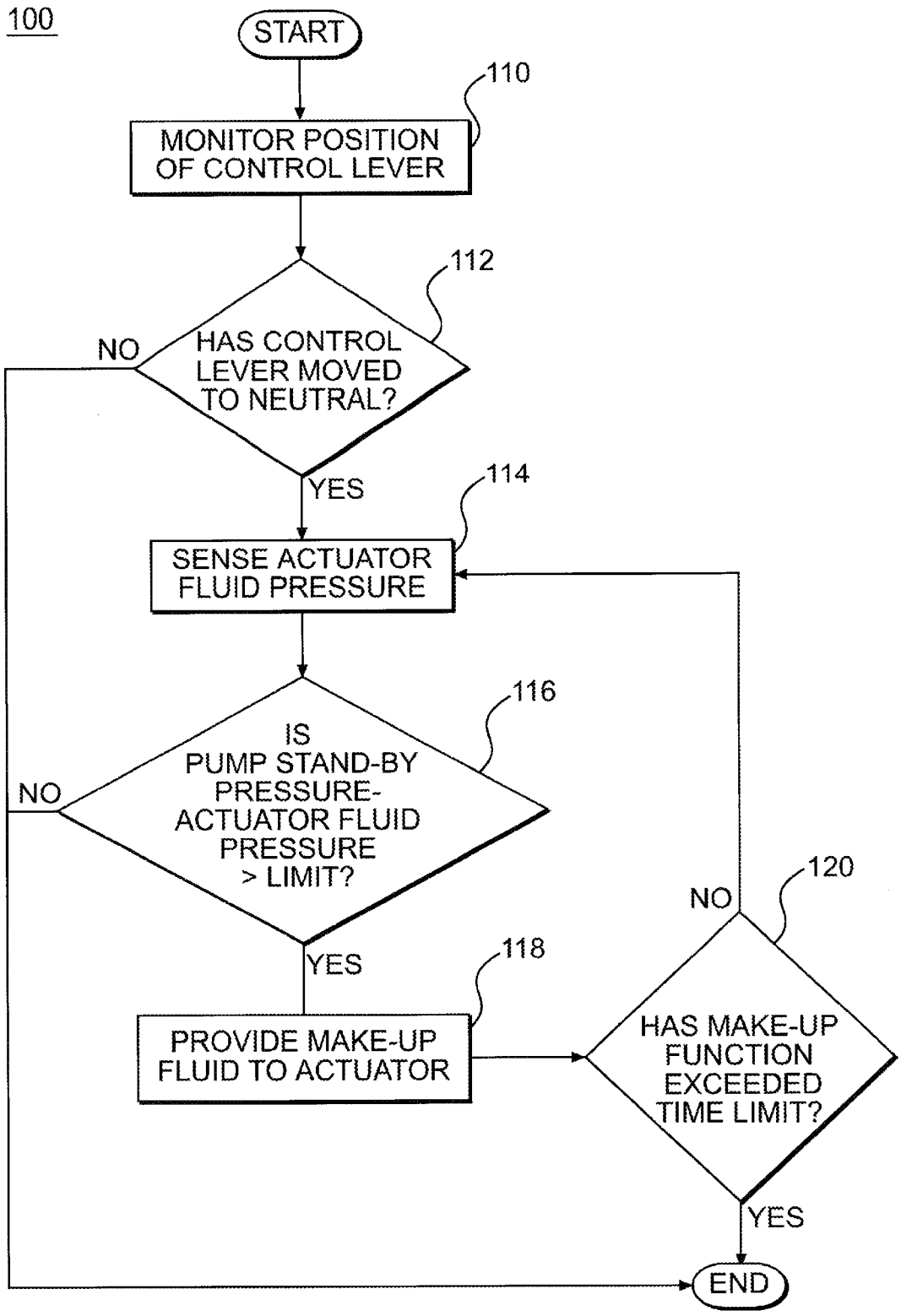
FIG. 3 is a flowchart illustrating a process for controlling an electro-hydraulic valve arrangement in accordance with the present invention.

In accordance with the present invention, a control device is provided. The control device governs the position of the electro-hydraulic valve arrangement to control the rate and direction of fluid flow to the hydraulic actuator. The control device overrides the control of the control lever over the electro-hydraulic valve arrangement when the difference between the pump stand-by pressure and the pressure of the fluid in the hydraulic actuator is greater than a predetermined pressure limit. This may occur, for example, when the control device receives a signal to close the electro-hydraulic valve arrangement, which may be generated by movement of the control lever to the neutral position, and the difference between the pump stand-by pressure and the pressure of the fluid in the hydraulic actuator is greater than the predetermined pressure limit. The flowchart of FIG. 3 illustrates a method 100 of controlling the electro-hydraulic valve arrangement.

As illustrated in FIGS. 1 and 2, a control device 54 is connected between control lever 44 and system 10. Control device 54 preferably includes a computer, which has all components required to run an application, such as, for example, a memory, a secondary storage device, a processor, such as a central processing unit, and an input device. One skilled in the art will appreciate that this computer can contain additional or different components. Furthermore, although aspects of the present invention are described as being stored in memory, one skilled in the art will appreciate that these aspects can also be stored on or read from other types of computer program products or computer-readable media, such as computer chips and secondary storage devices, including hard disks, floppy disks, CD-ROM, or other forms of RAM or ROM.

Control device 54 governs the position of electro-hydraulic valve arrangement 16 and thereby controls the rate and direction of fluid flow into and out of hydraulic actuator 12. Control device 54 is connected to first solenoid 72 with a control line 60, to second solenoid 74 with a control line 58, to third solenoid 82 with control line 62, and to fourth solenoid 84 with control line 63. By selectively energizing and de-energizing first, second, third, and fourth solenoids 72, 74, 82, and 84, control device 54 controls the rate and direction of fluid flow into and out of first and second chambers 38 and 40 of hydraulic actuator 12.

Similarly, in the embodiment of FIG. 2, control device 54 is connected to first and second solenoids 72 and 74 of first metering valve 70 and to third and fourth solenoids 82 and 84 of second metering valve 80. By selectively energizing and de-energizing first, second, third and fourth solenoids 72, 74, 82, and 84, control device 54 controls the rate and direction of fluid flow into and out of first and second chambers 38 and 40 of hydraulic actuator 12.

Control device 54 governs the position of electro-hydraulic valve arrangement 16 based on input signals received from control lever 44 through control line 56. When control lever 44 is moved towards the first operative position to move load 14 in the first direction (as indicated by arrow 41), control device 54 energizes the appropriate solenoid, or solenoids, to connect first chamber 38 with pump 68 and second chamber 40 with tank 20. When control lever 44 is moved to the second operative position to move load 14 in the second direction (as indicated by arrow 45), control device 54 energizes the appropriate solenoid, or solenoids, to connect second chamber 40 with pump 68 and first chamber 38 with tank 20. When control lever 44 is moved to a neutral position, control device 54 de-energizes all solenoids so that electro-hydraulic valve arrangement 16 returns to a closed position to prevent fluid from flowing into or out of hydraulic actuator 12.

As shown in FIGS. 1 and 2, control device 54 is also connected to first pressure gauge 35 through a control line 64 and to second pressure gauge 36 through a control line 66. First pressure gauge 35 sends a pressure reading to control device 54 that is representative of the fluid pressure in first chamber 38 of hydraulic actuator 12. Second pressure gauge 36 sends a pressure reading to control device 54 that is representative of the fluid pressure in second chamber 40 of hydraulic actuator 12.

Industrial Applicability

The operation of an embodiment of the aforementioned system will now be described with reference to the attached drawings. An exemplary method 100 for controlling an electro-hydraulic valve arrangement is presented in the flowchart of FIG. 3. Method 100 may be implemented in the system of the present invention, for example, by an application stored in the memory of the computer of control device 54.

Control device 54 monitors the position and/or movement of control lever 44 (step 110). As described previously, control device 54 governs the position of electro-hydraulic valve arrangement 16 based on the position of control lever 44. Control lever 44 sends signals, or other representative indications, of its current position and/or any change in position to control device 54 through control line 56.

When control device 54 receives a signal indicating that the operator has moved control lever 44 to the neutral position (step 112), control device 54 de-energizes the currently energized solenoids to allow the respective springs to return electro-hydraulic valve arrangement 16 to the closed position. As electro-hydraulic valve arrangement 16 returns to the closed position, control device 54 receives signals from first and second pressure gauges 35 and 36 indicating the fluid pressure within first and second chambers 38 and 40 of hydraulic actuator 12.

In certain circumstances, such as, for example, when an operator attempts to stop a work implement that is carrying a heavy load, an overpressure situation may be created within hydraulic actuator 12 or within one of fluid lines 50 and 52. Such an overpressure situation may be created, when hydraulic actuator 12 is moving in the first direction (as indicated by arrow 41) and electro-hydraulic valve arrangement 16 is closed or is approaching the closed position to prevent, or substantially restrict, fluid from flowing from second chamber 40 to tank 20. The momentum of load 14 continues to exert a force on the fluid in second chamber 40. Because the fluid cannot exit second chamber 40, the result is an increase in the pressure in second chamber 40 and in fluid line 52.

If the fluid pressure in second chamber 40 or in fluid line 52 increases to an overpressure level, pressure relief valve 34 opens to allow fluid to flow from second chamber 40 to tank 20, thereby preventing the pressure from exceeding the overpressure level. However, the decrease in volume of fluid in second chamber 40 allows piston 42 to move in the first direction, thereby increasing the volume of first chamber 38. The increased volume in first chamber 38 results in a decreased pressure within first chamber 38. If first chamber 38 experiences a significant drop in pressure, first chamber 38 may experience cavitation, which is potentially damaging to the equipment.

Control device 54 monitors the pressure of the fluid in first and second chambers 38 and 40 (step 114) to prevent either chamber from experiencing cavitation. Specifically, control device 54 determines if the difference between the pump stand-by pressure ($P_{sb}$), which may be a constant value, and the monitored pressure in one of the chambers of the hydraulic actuator ($P_a$) is greater than a predetermined pressure limit ($P_1$), i.e. if $P_{sb}-P_a>P_1$. (Step 116). In one embodiment, $P_1$ is approximately 50 kPa (7.25 psi). However, this predetermined pressure limit will vary depending upon particular applications.

If the difference between the pump stand-by pressure and the pressure in one of the chambers is greater than the predetermined pressure limit, control device 54 will energize the appropriate solenoid to either prevent electro-hydraulic valve arrangement 16 from completely closing and/or open the electro-hydraulic valve arrangement 16. In either event, control device 54 ensures that electro-hydraulic valve arrangement 16 allows additional fluid, or "make-up" fluid, to flow into the chamber experiencing the cavitating condition. (Step 118). Thus, by overriding the control of the control lever over the electro-hydraulic valve arrangement, control device 54 may prevent hydraulic actuator 12 from experiencing cavitation.

Control device 54 opens electro-hydraulic valve arrangement 16 to provide a certain flow rate of make-up fluid to the particular chamber. (Step 118) The make-up flow rate is based on the ratio of the pressure in the chamber of the hydraulic actuator ($P_a$) to the pump stand-by pressure ($P_{sb}$), which may be a constant value. The following calculation may be used to determine the flow rate of make-up fluid ($Q_{mu}$):

$$Q_{mu} = Q_1 * \left(1 - \frac{P_a}{P_{sb}}\right)$$

where $Q_1$ represents a constant flow rate for the particular metering valve being controlled. As will be understood from this equation, the make-up flow rate ($Q_{mu}$) varies in an inverse relationship to the ratio of the hydraulic actuator pressure ($P_a$) to the pump stand-by pressure ($P_{sb}$). In other words, the make-up flow rate ($Q_{mu}$) will be greatest when the ratio of the hydraulic actuator pressure ($P_a$) to the pump stand-by pressure ($P_{sb}$) is the smallest. The present invention further contemplates that the make-up flow rate ($Q_{mu}$) will decrease as the hydraulic actuator pressure ($P_a$) approaches the pump-stand-by pressure ($P_{sb}$)

Control device 54 will close electro-hydraulic valve arrangement 16 to stop the flow of make-up fluid when the difference between the pump stand-by pressure ($P_{sb}$) and the pressure in the hydraulic chamber ($P_a$) is no longer greater than the predetermined limit ($P_1$) (step 116). Control device 54 may also close electro-hydraulic valve arrangement 16 after a predetermined time limit has expired (step 120). In one contemplated embodiment, the predetermined time limit is approximately 10 seconds. It is expected that the system can provide enough make-up fluid to the hydraulic actuator within this time limit to prevent the hydraulic actuator from experiencing cavitation.

In addition to avoiding the problems associated with cavitation, the system and method of the present invention also avoid "hunting" for a precise pressure equilibrium. The system will not attempt to provide make-up flow unless the pressure difference is greater than a predetermined pressure limit. In addition, because the system will only provide make-up flow for a predetermined time limit, the system will not continue attempting to add make-up flow for an extended period of time. Thus, the control device will not repeatedly open and close the electro-hydraulic valve arrangement as the system hunts for pressure equilibrium.

Thus, the present invention has wide applications in a variety of machines incorporating hydraulic actuators. The present invention provides advantages in that it provides a cost effective and highly flexible control for hydraulic systems wherein there is a need to provide make-up flow to an actuator.

It will be apparent to those skilled in the art that various modifications and variations can be made in the method and system for controlling an electro-hydraulic valve arrangement without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A method of controlling an electro-hydraulic valve arrangement actuated by a control lever having a neutral position, the electro-hydraulic valve arrangement disposed between a pump having a stand-by pressure and an actuator, the method comprising the steps of:

sensing a first pressure representative of the fluid pressure in the actuator;

comparing the first pressure to the pump stand-by pressure; and overriding the control of the control lever over the electro-hydraulic valve arrangement and allowing fluid to flow from the pump through the electro-hydraulic valve arrangement to the actuator when the difference between the pump stand-by pressure and the first pressure is greater than a predetermined pressure limit.

2. The method of claim 1, further including the steps of:

monitoring movement of the control lever, where movement of the control lever to the neutral position acts to close the electro-hydraulic valve arrangement and thereby prevent fluid from flowing through the electro-hydraulic valve arrangement to the actuator; and overriding the control of the control lever over the electro-hydraulic valve arrangement to allow fluid to flow from the pump through the electro-hydraulic valve arrangement to the actuator in response to the control lever being moved to the neutral position and the difference between the pump stand-by pressure and the first pressure being greater than a predetermined pressure limit.

3. The method of claim 2, wherein the step of overriding the control of the control lever is performed for a predetermined time limit starting in response to movement of the control lever to the neutral position.

4. The method of claim 1, wherein the step of overriding the control of the control lever is completed when the difference between the pump stand-by pressure and the first pressure is less than the predetermined pressure limit.

5. The method of claim 1, further including the step of controlling the rate of fluid flow to the actuator when the control lever is overridden based on the ratio of the first pressure and the pump stand-by pressure.

6. The method of claim 5, wherein the rate of fluid flow to the actuator is decreased as the first pressure approaches the pump stand-by pressure.

7. A method of controlling a flow of fluid from a pump having a stand-by pressure through an electro-hydraulic valve arrangement having an outlet, the method comprising the steps of:

moving the electro-hydraulic valve arrangement to a closed position to prevent fluid from flowing through the electro-hydraulic valve arrangement in response to a received signal to close the electro-hydraulic valve arrangement;

sensing a first pressure representative of the fluid pressure at the outlet of the electro-hydraulic valve arrangement;

comparing the first pressure to the pump stand-by pressure; and opening the electro-hydraulic valve arrangement allowing fluid to flow from the pump through the electro-hydraulic valve arrangement when the difference between the pump stand-by pressure and the first pressure is greater than a predetermined pressure limit.

8. The method of claim 7, further including the step of closing the electro-hydraulic valve arrangement upon the expiration of a predetermined time limit.

9. The method of claim 7, further including the step of closing the electro-hydraulic valve arrangement when the difference between the pump stand-by pressure and the first pressure is less than the predetermined pressure limit.

10. The method of claim 7, further including the step of controlling the rate of fluid flow through the electro-hydraulic valve arrangement based on the ratio of the first pressure and the pump stand-by pressure.

11. The method of claim 10, wherein the rate of fluid flow through the electro-hydraulic valve arrangement is decreased as the first pressure approaches the pump stand-by pressure.

12. A system for controlling a flow of fluid to an actuator, comprising:

a pump having a stand-by pressure;

an electro-hydraulic valve arrangement in fluid connection with the pump and the actuator, the electro-hydraulic valve arrangement operable to control the amount of fluid flowing from the pump to the actuator;

a control lever having a neutral position, where movement of the control lever to the neutral position acts to close the electro-hydraulic valve arrangement and prevent the flow of fluid to the actuator;

a pressure sensor operable to sense a first pressure representative of the pressure of the fluid within the actuator; and a control device operable to override the control of the control lever over the electro-hydraulic valve arrangement when the difference between the pump stand-by pressure and the first pressure is greater than a predetermined pressure limit.

13. The system of claim 12, wherein the actuator includes a first chamber and a second chamber.

14. The system of claim 13, wherein the hydraulic valve arrangement includes a first metering valve operable to control the rate of fluid flow into the first chamber and a second metering valve operable to control the rate of fluid flow into the second chamber.

15. The system of claim 14, wherein the first metering valve is an independent metering valve and the second metering valve is an independent metering valve.

16. The system of claim 15, wherein the hydraulic valve arrangement further includes a third independent metering valve operable to control the rate of fluid flow out of the first chamber and a fourth independent metering valve operable to control the rate of fluid flow out of the second chamber.

17. The system of claim 12, wherein the pressure sensor includes a first pressure gauge adapted to sense a pressure representative of the fluid in the first chamber and a second pressure gauge adapted to sense a pressure representative of the fluid in the second chamber.

* * * * *